United States Patent [19]

Wiczer

[11] 4,438,928

[45] Mar. 27, 1984

[54] PINBALL GAME WITH GANGED KICKER MECHANISMS

[75] Inventor: Max Wiczer, Skokie, Ill.

[73] Assignee: Wico Corporation, Niles, Ill.

[21] Appl. No.: 409,412

[22] Filed: Aug. 19, 1982

[51] Int. Cl.[3] ..... A63D 13/00

[52] U.S. Cl. ..... 273/121 R; 273/129 V

[58] Field of Search ..... 273/85 A, 85 B, 121 R, 273/121 A, 121 D, 121 E, 122 R, 122 A, 127 R, 127 C, 129 R, 129 S, 129 V; 200/61.1, 61.11

[56] References Cited

U.S. PATENT DOCUMENTS

| | | | |
|---|---|---|---|
| 1,885,036 | 10/1932 | Gravatt | 273/119 R |
| 1,972,993 | 9/1934 | Huenergardt | 273/121 E |
| 2,089,514 | 8/1937 | Walker | 273/121 R |
| 2,507,258 | 5/1950 | Kohler | 273/85 C |
| 2,551,698 | 5/1951 | Pearl et al. | 273/121 A |
| 2,610,058 | 9/1952 | Hooker | 273/121 A |
| 4,203,602 | 5/1980 | Kral | 273/121 A |

FOREIGN PATENT DOCUMENTS

| | | | |
|---|---|---|---|
| 646265 | 9/1962 | Italy | 273/121 R |

OTHER PUBLICATIONS

"2506 Roto Ball", 1977, Marx Catalogue, p. 30.

*Primary Examiner*—Richard T. Stouffer

*Attorney, Agent, or Firm*—Dithmar, Stotland, Stratman & Levy

[57] ABSTRACT

A pinball game includes plural parallel columns of kickers, each kicker being responsive to ball impact thereon for propelling the ball therefrom in a predetermined direction. Each kicker is rotatable for varying the predetermined direction and the kickers in each column are ganged together for manual simultaneous rotation thereof. Different types of kickers may be provided in different columns.

23 Claims, 3 Drawing Figures

PINBALL GAME WITH GANGED KICKER MECHANISMS

BACKGROUND OF THE INVENTION

The present invention relates to pinball games of the type wherein a ball rolls along an inclined playfield board for interaction with targets or the like. In particular, the invention relates to a pinball game which utilizes a plurality of ball propelling devices which are ganged together for simultaneous operation.

Many variations of pinball-type games are known which include means for propelling the ball along the playfield board after it has been introduced into play. It is also known to gang together plural ones of said propelling devices for simultaneous operation. For example, simultaneously-operated flippers are disclosed in U.S. Pat. Nos. 1,885,036 and 2,551,698, the former disclosing manually-operated flippers and the latter disclosing solenoid-actuated flippers. But in flipper-type ball propelling devices the direction in which the ball is propelled is relatively difficult to control, this direction being a function of a timing of the flipper operation.

It is also known to provide in pinball games automatically-actuated knickers or bumpers which respond to ball impact thereon for propelling the ball therefrom in a predetermined direction. Such kicker devices are disclosed, for example, in U.S. Pat. No. 4,203,602. However, such kicker devices always operate independently of one another and the direction in which they propel the ball is fixed.

SUMMARY OF THE INVENTION

It is a general object of this invention to provide an improved pinball game which affords a unique arrangement of ball propelling devices for providing a novel mode of play.

It is an important object of this invention to provide a pinball game which provides a plurality of kicker mechanisms, wherein the ball-propelling directions thereof are simultaneously controlled.

In connection with the foregoing object, it is another object of this invention to provide a pinball game of the type set forth, wherein each of the kicker mechanisms is of the type which is automatically responsive to ball impact thereon.

Another object of this invention is the provision of a pinball game of the type set forth which includes plural arrays of ganged kicker mechanisms arranged for cooperation to kick the ball back and forth therebetween.

These and other objects of the invention are attained by providing in a pinball game in which a ball rolls along an inclined playfield board, the improvement comprising a plurality of kicker mechanisms carried by the playfield board, each of the kicker mechanisms being operative for engagement with the ball to propel the ball therefrom in a predetermined direction, and direction control means coupled to all of the kicker mechanisms for simultaneous control thereof to vary the predetermined directions thereof.

The invention consists of these and other novel features and the combination of parts hereinafter fully described, illustrated in the accompanying drawings, and particularly pointed out in the appended claims, it being understood that various changes in the details may be made without departing from the spirit, or sacrificing any of the advantages of the invention.

BRIEF DESCRIPTON OF THE DRAWINGS

DESCRIPTION OF THE PREFERRED EMBODIMENTS

Figure 1:
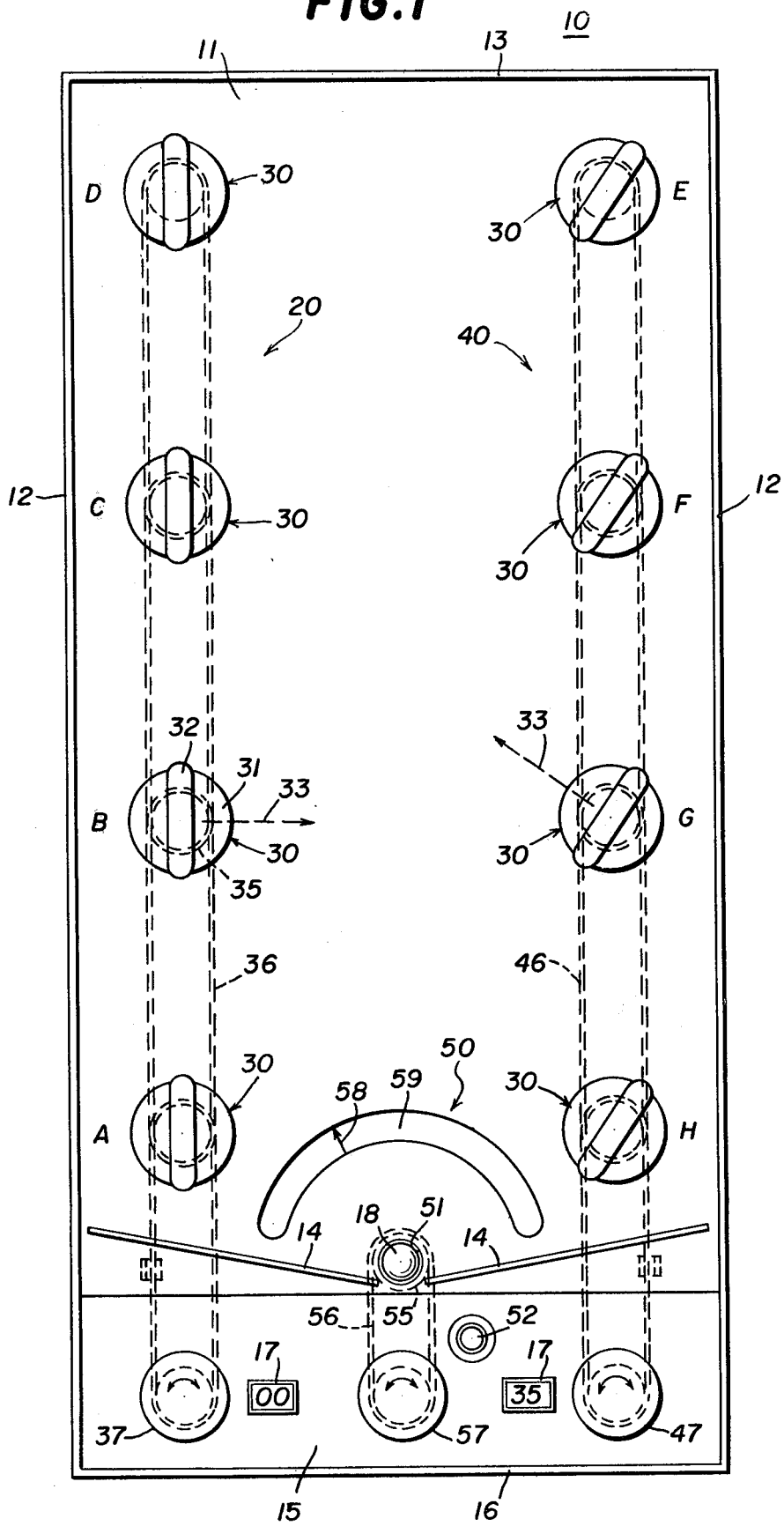
FIG. 1 is a top plan view of a pinball game constructed in accordance with and embodying the features of a first embodiment of the present invention.

Referring to FIG. 1 of the drawings, there is illustrated a pinball game, generally designated by the numeral 10, constructed in accordance with and embodying the features of a first embodiment of the present invention. The pinball game 10 includes a flat planar playfield board 11 bounded along the opposite sides thereof by upstanding side walls 12 and at one end by an upstanding end wall 13. Upstanding guide walls 14 are provided at the lower end of the playfield board 11. A control panel 15 is provided adjacent to the playfield board 11 and is bounded by an upstanding end wall 16. Scoring indicators 17 may be provided on the control panel 15. In use, a ball 18 rolls along the upper surface of the playfield board 11, which is preferably inclined downwardly toward the guide walls 14.

Carried by the playfield board 11 are two arrays 20 and 40 of kicker mechanisms 30. The arrays 20 and 40 are in the form of straight columns respectively disposed adjacent to the side walls 12 and substantially parallel thereto, with the kicker mechanisms 30 in each column being substantially equidistantly spaced apart. Preferably the kicker mechanisms 30 of the array 20 are respectively disposed opposite corresponding kicker mechanisms 30 in the array 40.

Each of the kicker mechanisms 30 is of the type which is automatically responsive to engagement of the ball 18 therewith for propelling the ball therefrom in a predetermined direction. Preferably, each kicker mechanism 30 is of the type disclosed in the application of Albin Peters, entitled "Wide Face Horizontally Movably Kicker for Pinball Game", Ser. No. 409,411 filed concurrently herewith, and assigned to the assignee of the present invention, the disclosure of which application is incorporated herein by reference.

Each kicker mechanism 30 includes an annular actuator member 31 mounted substantially parallel to the playfield board 11 just above the upper surface thereof for tilting movement with respect thereto upon rolling of the ball 18 thereonto for closing an associated switch to actuate a solenoid (not shown) of the kicker mechanism 30. The kicker mechanism 30 also includes a kicker member 32 in the form of an elongated bar extending diametrically across the actuator member 31 and coupled by suitable linkage mechanism (not shown) to an associated solenoid (not shown) for movement parallel to the playfield board 11 in response to actuation of the solenoid. Thus, when the ball 18 engages the actuator member 31, the kicker member 32 propels the ball 18 therefrom in a predetermined direction, designated by the arrow 33, perpendicular to the longitudinal axis of the kicker member 32.

Each of the kicker mechanisms 30 is coupled to a rotatable mount 35 for effecting rotation of the kicker member 32 about an axis extending through the center of the actuator member 31 substantially perpendicular to the playfield board 11. Preferably, the rotatable mount 35 is of the type disclosed in the copending application of Albin Peters, entitled "Rotatable Kicker for Pinball Game", Ser. No. 409,411, filed concurrently herewith and assigned to the assignee of the present invention, the disclosure of which application is incorporated herein by reference.

The rotatable mounts 35 of the kicker mechanisms 30 in the array 20 are all interconnected by a common drive means 36, which is in turn coupled to a manually rotatable control knob 37 on the control panel 15. The drive means 36, which may, for example, be an endless band, chain or the like, responds to rotation of the control knob 37 for effecting a simultaneous equal rotation of each of the rotatable mounts 35, for effecting a ganged control of the orientation of the kicker mechanisms 30 thereby to vary the predetermined direction in which the ball 18 is propelled therefrom.

In like manner, the rotatable mounts 35 of each of the kicker mechanisms 30 in the array 40 are interconnected by a drive means 46, which is in turn coupled to a manually-rotatable control knob 47 on the control panel 15 for effecting simultaneous ganged control of the orientation of the kicker mechanisms 30 in the array 40 to vary the predetermined direction in which the ball 18 is propelled therefrom.

The pinball game 10 also includes a kicker mechanism 50 disposed substantially midway between the arrays 20 and 40 adjacent to the lower end of the playfield board 11. Preferably, the kicker mechanism 50 is of the type disclosed in the copending application of Max Wiezer and Albin Peter entitled "Pinball Game with Oscillating Shooter", Ser. No. 326,172, filed Nov. 30, 1981, assigned to the assignee of the present invention, the disclosure of which application is incorporated herein by reference. The kicker mechanism 50 includes a cylindrical pocket 51 formed in the playfield board 11 for receiving the ball 18 therein. Disposed in the pocket 51 is a kicker member (not shown) for ejecting the ball 18 from the pocket 51 and along the playfield board 11 in a predetermined direction, this kicker member being actuatable by an actuator button 52 on the control panel 15. The kicker member is carried by a rotatable mount 55 which is coupled by drive means 56, which may be of the same type as the drive means 36 and 46, to a manually rotatable control knob 57 on the control panel 15 for effecting rotation of the rotatable mount 55 to vary the predetermined direction in which the ball 18 will be propelled from the pocket 51. The kicker mechanism 50 also includes a direction indicator 58 which is visible through an arcuate viewing window 59 in the playfield board 11 for indicating the orientation of the rotatable amount 55 and, thereby, the direction in which the ball 18 will be propelled from the pocket 51.

Figure 3:
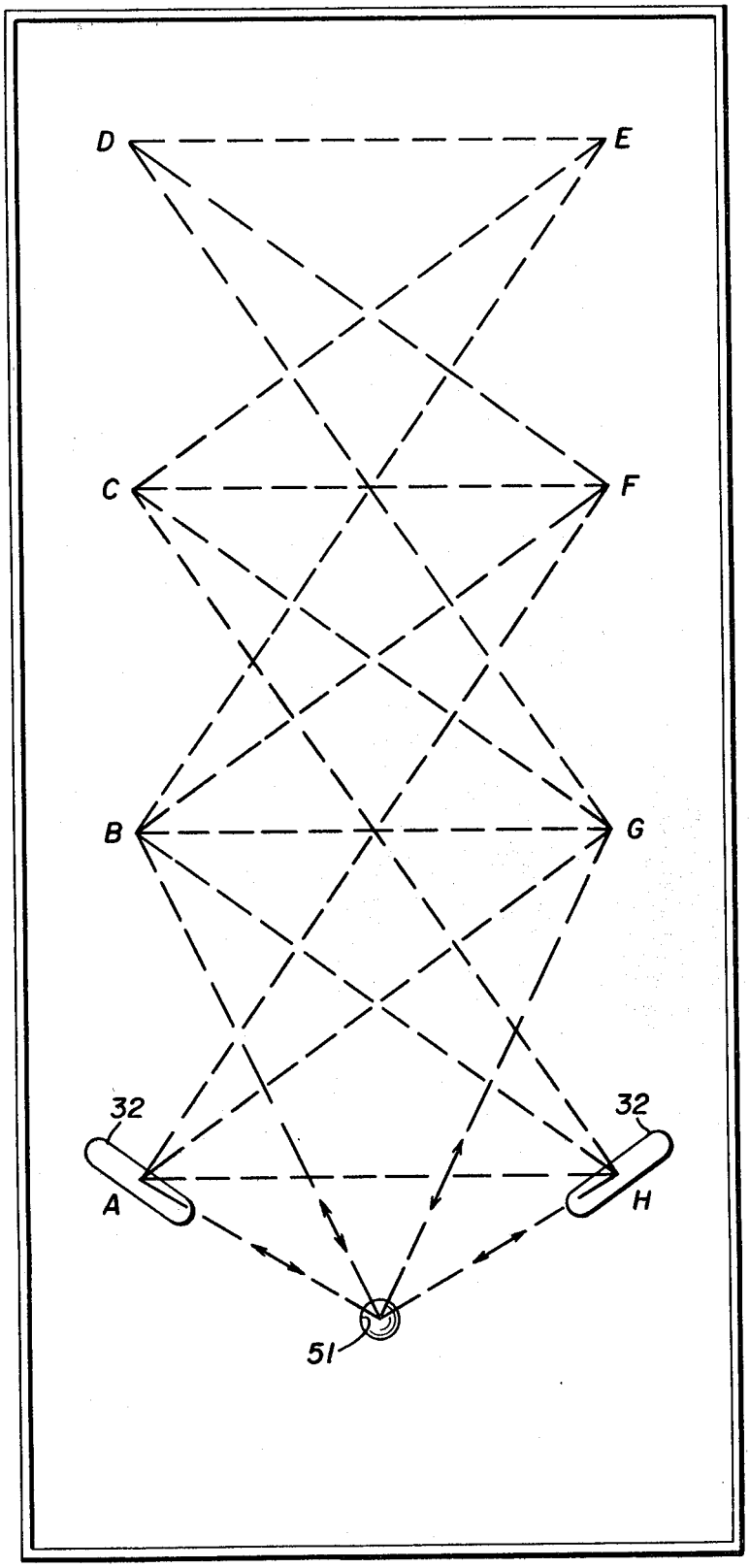
FIG. 3 is a top plan view illustrating possible ball paths in the pinball game of FIG. 1.

The kicker mechanisms 30 in the arrays 20 and 40 have respectively been designated by letters A through H. Referring also to FIG. 3 of the drawings, the operation of the pinball game 10 will be described. In FIG. 3, the pocket 51 and two kicker members 32 of representative kicker mechanisms 30 in each of the arrays 20 and 40 have been illustrated, with the positions of the other kicker mechanisms 30 being indicated by their designating letters. Dashed lines indicate representative ones of the possible ball paths among the kicker mechanisms 30 and 50, it being understood that other paths are possible. In general, the kicker member of the kicker mechanism 50 can be directed toward any one of the kicker mechanisms 30, and any one of the kicker mechanisms 30 can be directed toward the pocket 51 or toward any one of the kicker members 32 in the opposite array. However, in practice it will be appreciated that, depending upon the kicking force imparted by the kicker mechanisms, certain ones of the kicker mechanisms 30 and 50 may be spaced so far apart that the ball cannot be propelled directly from one to another.

In general, it is an object of the game to use the kicker mechanisms 30 in the arrays 20 and 40 in cooperation with one another to move the ball along the playfield board 11. Initially, the ball will be introduced into play by the kicker mechanism 50, the player manually directing the kicker mechanism 50 toward a selected one of the kicker mechanisms 30 by use of the control knob 57 and then actuating the ball with the actuator button 52. One of the kicker mechanisms 30 toward which the ball is aimed can in turn be manually directed by use of the control knobs 37 or 47 toward another one of the kicker mechanisms 30 in the opposite array. In this manner, the ball can be kept in play between the arrays 20 and 40 and can be moved in a zigzag fashion between the top and bottom of the playfield board 11. It will be understood that in addition to the kicker mechanisms 30 and 50, there will typically also be provided on the playfield board 11 a number of scoring targets (not shown), at which the kicker mechanisms 30 and 50 can also be aimed. It will also be appreciated that many variations of this type of pinball game would be possible, the fundamental aspect being the use of kicker mechanisms which propel the ball therefrom in a predetermined direction, and manual control means for manually varying that predetermined direction so that the ball can be aimed.

Figure 2:
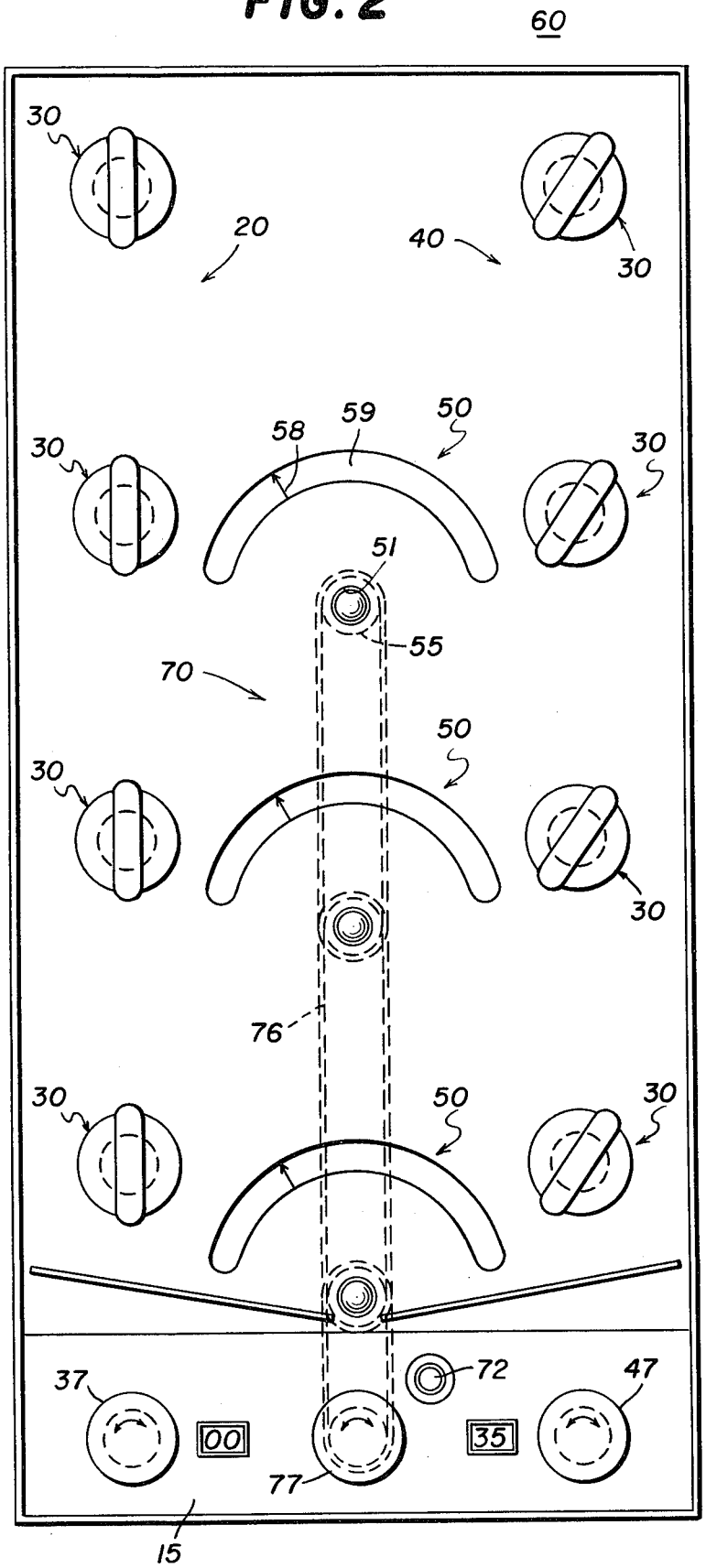
FIG. 2 is a view similar to FIG. 1 of a second embodiment of the present invention.

Referring now also to FIG. 2 of the drawings, there is illustrated an alternative embodiment of the pinball game of the present invention, generally designated by the numeral 60. The pinball game 60 is substantially identical to the pinball game 10, with the exception that instead of a single kicker mechanism 50 the pinball game 60 includes an array 70 of a plurality of kicker mechanisms 50. In the illustrated embodiment, the array 70 includes three kicker mechanisms 50 arranged in a column parallel to the arrays 20 and 40, with the pockets 51 of the kicker mechanisms 50 being substantially equidistantly spaced apart. Preferably, all of the kicker members of the kicker mechanisms 50 are connected for simultaneous actuation by an actuator button 72 on the control panel 15. The rotatable mounts 55 of the kicker mechanisms 50 are all commonly connected to a drive means 76 which is in turn coupled to a manually-rotatable control knob 77 on the control panel 15. Thus, it will be appreciated that by rotation of the control knob 77 there can be effected a simultaneous ganged rotation of the rotatable mounts 55 for varying the direction in which the ball 18 will be propelled from the pockets 51. The play of the pinball game 60 will be substantially like that of the pinball game 10, with the addition of many other possible ball paths by reason of the additional kicker mechanisms 50.

From the foregoing, it can be seen that there has been provided an improved pinball game which is characterized by the use of a plurality of ganged kicker mechanisms of the type which are operative for engagement with the ball to propel the ball therefrom in a predetermined direction, the kicker mechanisms being simultaneously controllable for varying the ball-propelling direction thereof.

I claim:

1. In a pinball game in which a ball rolls along an inclined playfield board, the improvement comprising a plurality of kicker mechanisms carried by the playfield board, each of said kicker mechanisms including a movable support and a kicker member carried by said support, each kicker member being movable with respect to its corresponding support for engagement with the ball to propel the ball therefrom in a predetermined direction, and direction control means coupled to all of said supports for simultaneous movement thereof, said direction control means being selectively operable during the normal course of play of the game to vary said predetermined directions of said supports, and kicker control means for controlling movement of said kicker members with respect to their respective said supports, said direction control means and said kicker control means being operable independently of each other.

2. The pinball game of claim 1, wherein each of said kicker mechanisms includes means responsive to engagement of the ball therewith for propelling the ball therefrom in a predetermined direction.

3. The pinball game of claim 2, wherein each of said kicker mechanisms includes a pocket to receive the associated ball for engagement with said responsive means below the upper surface of the playfield board.

4. The pinball game of claim 2, wherein each of said kicker members engages the associated ball above the playfield board.

5. The pinball game of claim 4, and further including a separate kicker mechanisms independent of said plurality of kicker mechanisms and including a pocket for receiving the associated ball therein, said separate kicker mechanism including means responsive to engagement of the ball therewith when the ball is disposed in said pocket for propelling the ball therefrom in a predetermined direction.

6. The pinball game of claim 1, wherein said predetermined directions for said kicker mechanisms are all parallel to one another.

7. The pinball game of claim 1, wherein said kicker mechanisms are arranged in a straight line.

8. The pinball game of claim 1, wherein said kicker mechanisms.

9. The pinball game of claim 1, wherein each of said supports is rotatable about an axis disposed substantially perpendicular to the playfield board, said predetermined direction being disposed substantiallly parallel to said playfield board and perpendicular to said axis.

10. The pinball game of claim 9, wherein said direction control means effects simultaneous rotation of said supports through substantially equal angles about their respective axes.

11. The pinball game of claim 10, wherein said direction control means is manually operable.

12. The pinball game of claim 1, wherein said direction control means is manually operable.

13. In a pinball game in which a ball rolls along an inclined playfield board, the improvement comprising a plurality of first kicker mechanisms carried by the playfield board, a plurality of second kicker mechanisms carried by the playfield board, each of said first and second kicker mechanisms including a movable support and a kicker member carried by said support, each kicker member being movable with respect to its corresponding support for engagement with the ball to propel the ball therefrom in a predetermined direction, first direction control means coupled to all of the supports of said first kicker mechanisms for simultaneous movement thereof, said first direction control means being selectively operable during the normal course of play of the game to vary said predetermined directions of the supports of said first kicker mechanisms, second direction control means coupled to all of the supports of said second kicker mechanisms for simultaneous movement thereof, said second direction control means being selectively operable during the normal course of play of the game to vary said predetermined directions of the supports of said second kicker mechanisms, the kicker control means for controlling movement of said kicker members with respect to their respective said supports, said first and second direction control means and said kicker control means being operable independently of one another.

14. The pinball game of claim 13, wherein said first and second kicker mechanisms are substantially identical in construction.

15. The pinball game of claim 13, wherein the kicker members of said first kicker mechanisms are adapted for engagement with the associated ball above the upper surface of the playfield board, each of said second kicker mechanisms including a pocket below the upper surface of the playfield board for receiving the associated ball therein.

16. The pinball game of claim 13, wherein each of said first and second direction control means is manually operable.

17. The pinball game of claim 13, wherein each of said first and second kicker mechanisms is responsive to engagement of the associated ball therewith for propelling the ball therefrom in said predetermined direction.

18. The pinball game of claim 13, wherein each of the supports of said first and second kicker mechanisms is mounted for rotation about an axis disposed substantially perpendicular to the playfield board.

19. The pinball game of claim 18, wherein each of said first and second direction control means is manually operable for rotating the associated supports about the respective axes thereof.

20. The pinball game of claim 13, wherein said first and second kicker mechanisms are substantially identical in construction, and further including a plurality of third kicker mechanisms carried by the playfield board and different in construction from said first and second kicker mechanisms, each of said third kicker mechanisms being operative for engagement with the ball to propel the ball therefrom in a predetermined direction, and third direction control means coupled to all of said third kicker mechanisms for simultaneous control thereof to vary said predetermined directions thereof.

21. The pinball game of claim 20, wherein each of said first and second and third kicker mechanisms is responsive to engagement of the ball therewith for propelling the ball therefrom in said predetermined direction.

22. The pinball game of claim 21, wherein each of said first and second kicker mechanisms is adapted for engagement with the associated ball above the upper surface of the playfield board, each of said third kicker mechanisms including a pocket below the upper surface of the playfield board for receiving the associated ball therein.

23. The pinball game of claim 13, wherein said first kicker mechanisms are arranged in a first straight line, said second kicker mechanisms being arranged in a second straight line spaced from and parallel to said first line.

* * * * *

UNITED STATES PATENT AND TRADEMARK OFFICE

CERTIFICATE OF CORRECTION

PATENT NO. : 4,438,928

DATED : March 27, 1984

INVENTOR(S) : Max Wiczer

It is certified that error appears in the above-identified patent and that said Letters Patent are hereby corrected as shown below:

Column 5, line 30, "mechanisms" should be --mechanism--.

line 42, after "mechanisms" insert --are substantially equidistantly spaced apart--

Column 6, line 9, "the" should be --and--.

Signed and Sealed this

*Seventeenth* Day of *July 1984*

[SEAL]

*Attest:*

GERALD J. MOSSINGHOFF

*Attesting Officer*

*Commissioner of Patents and Trademarks*